US011180311B2

(12) United States Patent
Marini

(10) Patent No.: US 11,180,311 B2
(45) Date of Patent: Nov. 23, 2021

(54) PACKAGE FOR VALUABLE PRODUCTS

(71) Applicant: PUSTERLA 1880 S.p.A., Venegono Inferiore (IT)

(72) Inventor: Roberto Marini, Mantova (IT)

(73) Assignee: PUSTERLA 1880 S.P.A., Venegono Inferiore (IT)

( * ) Notice: Subject to any disclaimer, the term of this patent is extended or adjusted under 35 U.S.C. 154(b) by 52 days.

(21) Appl. No.: 16/596,014

(22) Filed: Oct. 8, 2019

(65) Prior Publication Data

US 2020/0109002 A1 Apr. 9, 2020

(30) Foreign Application Priority Data

Oct. 9, 2018 (IT) ..... 102018000009294

(51) Int. Cl.
*B65D 85/30* (2006.01)
*B65D 43/02* (2006.01)
*B65D 57/00* (2006.01)

(52) U.S. Cl.
CPC ..... *B65D 85/30* (2013.01); *B65D 43/0204* (2013.01); *B65D 57/00* (2013.01)

(58) Field of Classification Search
CPC .... B65D 43/26; B65D 43/36; B65D 43/0204; B65D 43/0212; B65D 43/22; B65D 57/00; B65D 83/005; B65D 85/04; B65D 85/30; B65D 85/1009; B65D 5/68; B65D 25/10; Y10S 206/804; A47K 10/422; A47K 2010/3233
USPC ..... 206/804, 254, 428, 761; 229/117.11, 229/117.24–117.26, 125.38, 160.2, 229/117.35; 220/495.06, 495.11, 754, 220/770, 799; 215/391; 221/198, 226, 221/249, 279, 52, 56
See application file for complete search history.

(56) References Cited

U.S. PATENT DOCUMENTS 45,764 A * 1/1865 Staunton ..... 62/371
265,985 A * 10/1882 Seabury ..... B65D 5/4287 229/125.01
577,416 A * 2/1897 Brown ..... B65D 5/36 229/117.02

(Continued)

FOREIGN PATENT DOCUMENTS

EP 1584565 A1 10/2005
GB 266958 3/1927

*Primary Examiner* — J. Gregory Pickett
*Assistant Examiner* — Brijesh V. Patel
(74) *Attorney, Agent, or Firm* — Cantor Colburn LLP

(57) ABSTRACT

A package for valuable products includes a support base having a supporting surface for a product to be supported; a hollow body that has an open portion for inserting the product. The hollow body is engageable to the support base along a relative movement direction perpendicular to the supporting surface. The package includes an opening mechanism between the support base and the hollow body and switchable between a closing condition, wherein the hollow body contacts the support base or is placed close to the latter, and an opening condition, wherein the hollow body is spaced from the support base to allow access to the product resting on the latter. The switching of the opening mechanism between the closing and opening conditions is operated by actuating a control element along a control direction transverse to the relative movement direction between the hollow body and the support base.

8 Claims, 7 Drawing Sheets

(56) References Cited

U.S. PATENT DOCUMENTS 866,243 A * 9/1907 Waechter ..... A45C 11/00 206/459.5
977,770 A * 12/1910 Wolf ..... B65D 5/3642 229/117.04
1,206,124 A * 11/1916 Meyers ..... B65D 85/1009 206/254
1,218,196 A * 3/1917 McCorkindale ..... B65D 5/68 229/125.22
1,322,290 A * 11/1919 Cibulka ..... B65D 5/68 229/125.22
1,323,335 A 12/1919 Terwilliger
1,680,539 A * 8/1928 Hadi ..... B65D 5/5213 206/761
1,901,717 A * 3/1933 Allen ..... B65D 5/5213 206/761
1,922,354 A * 8/1933 Burke ..... B65D 83/005 206/761
1,985,516 A * 12/1934 Parr ..... B65D 5/5213 206/761
1,991,427 A * 2/1935 Spachmann ..... B65D 83/005 206/761
2,110,615 A * 3/1938 Wilcox ..... B65D 83/005 206/761
2,112,551 A * 3/1938 Anderson ..... B65D 83/005 206/761
2,281,836 A * 5/1942 Engel ..... B30B 9/3053 100/34
2,321,802 A * 6/1943 Deubener ..... B30B 9/3053 100/34
2,346,407 A * 4/1944 Wright ..... B65D 85/10 206/254
2,676,835 A * 4/1954 Mckinney ..... B65D 83/0817 221/59
2,837,263 A * 6/1958 Nasello ..... B65D 83/0817 221/59
2,849,154 A * 8/1958 Gartrell ..... B65D 83/0817 221/59
3,231,139 A * 1/1966 Bouet ..... B65D 83/0817 221/59
3,301,453 A * 1/1967 Stewart ..... B65D 83/0817 221/59
3,439,827 A * 4/1969 Marland ..... B65D 83/0817 221/59
3,647,114 A * 3/1972 Bleuer ..... B65D 83/0817 221/59
4,300,611 A * 11/1981 Silverman ..... D06F 95/004 220/9.1
4,541,540 A * 9/1985 Gretz ..... B65D 25/16 206/804
4,643,380 A * 2/1987 Copeland ..... A63H 5/00 206/804
5,165,583 A * 11/1992 Kouwenberg ..... B65D 85/04 206/395
5,337,915 A * 8/1994 Hall, Jr. ..... B65D 25/16 206/804
6,634,921 B1 * 10/2003 Coulthard, Jr. ..... A63H 5/00 206/804
6,827,217 B2 * 12/2004 Matsuguchi ..... B65D 85/04 206/395
7,556,167 B2 * 7/2009 Giwargis ..... B65D 83/005 220/23.83
7,988,010 B2 * 8/2011 Yang ..... A45C 11/00 220/375
2007/0227929 A1 10/2007 Mauerhan
2013/0081967 A1 * 4/2013 Gaul ..... B65D 5/445 206/409
2015/0245746 A1 * 9/2015 Chorne ..... A47K 10/422 221/1
2019/0177068 A1 * 6/2019 Sandow ..... B65D 5/6664

* cited by examiner

PACKAGE FOR VALUABLE PRODUCTS

CROSS REFERENCE TO RELATED APPLICATION

This application is related to and claims the benefit of Italian Patent Application Number 102018000009294 filed on Oct. 9, 2018, the entire contents of which are incorporated herein by reference in their entirety.

TECHNICAL FIELD

The present disclosure relates to a package for valuable products.

BACKGROUND

The subject matter of the present disclosure can be used particularly in the sector of the paper and cardboard industry and is specifically intended for packages, wrapping, boxes, coated boxes, caskets, cases and/or the like for the containment, display, marketing and sale of valuable and luxury products.

As is known, the containment and marketing of valuable alcoholic products such as liqueurs, spirits, wines and/or the like, are performed by means of extravagant packages with great care and attention to every detail.

In particular, various packages made of paper material are known such as pasteboard or cardboard, with a box-shaped conformation that envisage suitable closing portions or flaps that can be folded and fixed to the body of the package itself for closing the related product to be contained.

Wooden packages or cases are also known, also with a box-shaped conformation, provided with appropriate closing lids appropriately hinged to the respective main bodies thereof or provided with sliding portions that can translate on the respective main bodies to allow access to the contents.

Although the aforementioned packages allow a satisfactory containment of the valuable products to be marketed, the Applicant has found that they are not however free from some drawbacks and can be improved in various aspects, mainly in relation to the ease and simplicity of opening them, as well as the convenience of accessing the product contained therein.

In particular, both in the case of pasteboard or cardboard packages, and in the case of wooden packages with hinged closing lids or sliding portions with a slider, the Applicant has found that to access the products contained therein it is necessary to proceed first to open the packages themselves, an operation that may be more or less complex according to the type of packages in question and/or the closing systems envisaged thereon, to then extract the products from the relative packages with the risk of dropping and breaking them.

BRIEF SUMMARY

The main purpose of the present disclosure is to propose a package for valuable products, able to solve the problems of the prior art.

A further purpose of the present disclosure is to propose a package for valuable products that is easy and simple to open.

Another purpose of the present disclosure is to propose a package for valuable products that allows the product to be housed in a base with reduced dimensions.

It is also an aim of the present disclosure to propose a package for valuable products that ensures the closure thereof and, therefore, the structural integrity of the product contained therein, also when the box is lifted by the lid only.

Another purpose of the present disclosure is to propose a package for valuable products that allows improved display of the product in the point of sale.

It is also a purpose of the present disclosure to propose a package for valuable products that is convenient in the opening operations and improves the opening experience of the package by consumers.

A further purpose of the present disclosure is to propose a package for valuable products that can be opened with a single gesture.

The purposes specified above and others, are substantially reached by a package for valuable products according to what is described and claimed below.

BRIEF DESCRIPTION OF THE DRAWINGS

The description will be made hereinbelow with reference to the accompanying drawings, provided for indicative purposes only and therefore not limiting, wherein.

DETAILED DESCRIPTION

Figure 1:
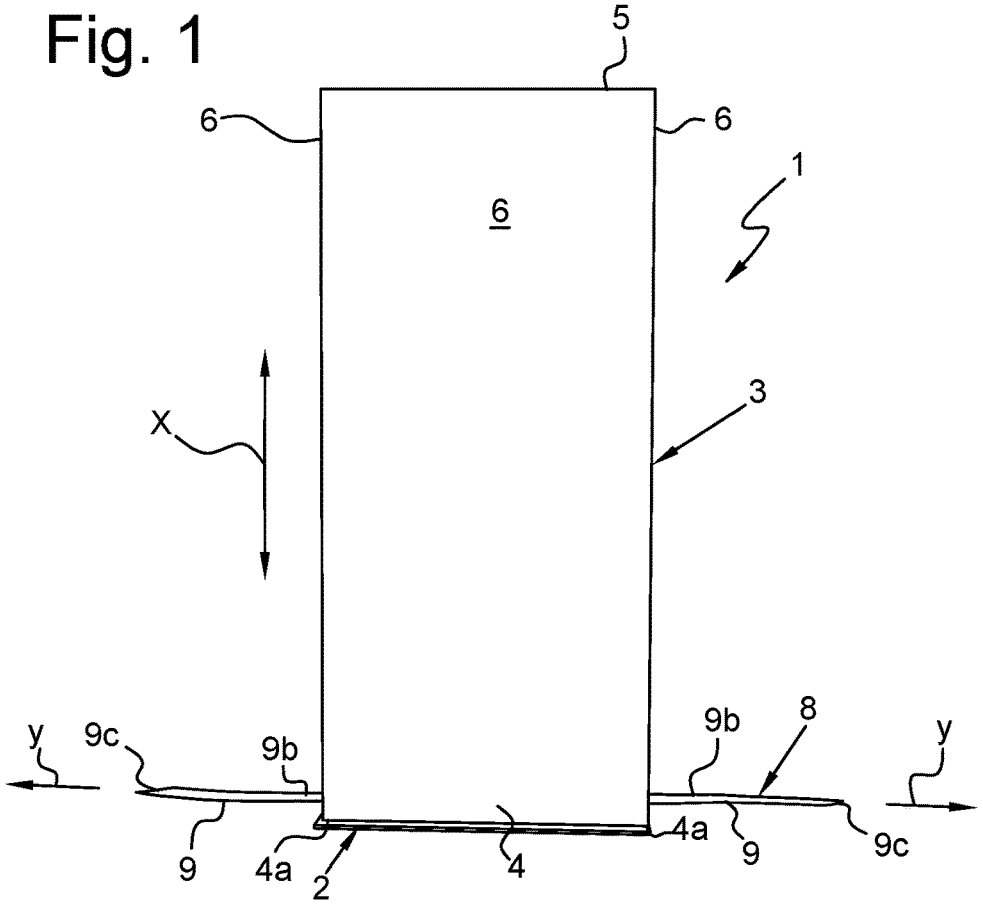
FIG. 1 is a front elevation view of a package for valuable products, according to the present disclosure, represented in a closing condition.
Figure 2:
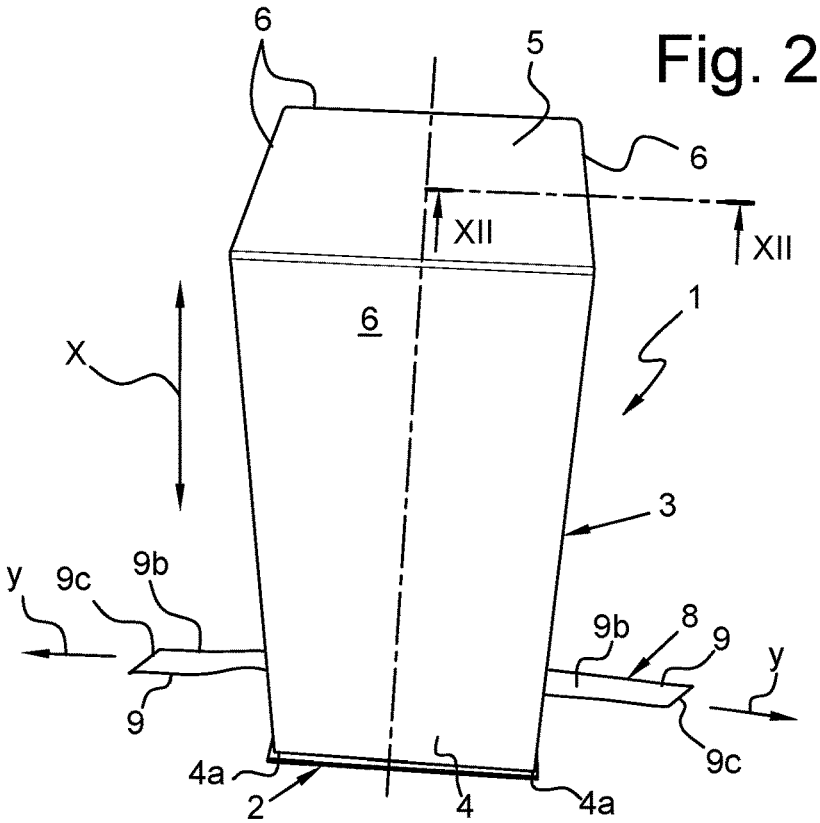
FIG. 2 is a perspective front view from above of the package of FIG. 1, represented in the closing condition.
Figure 3:
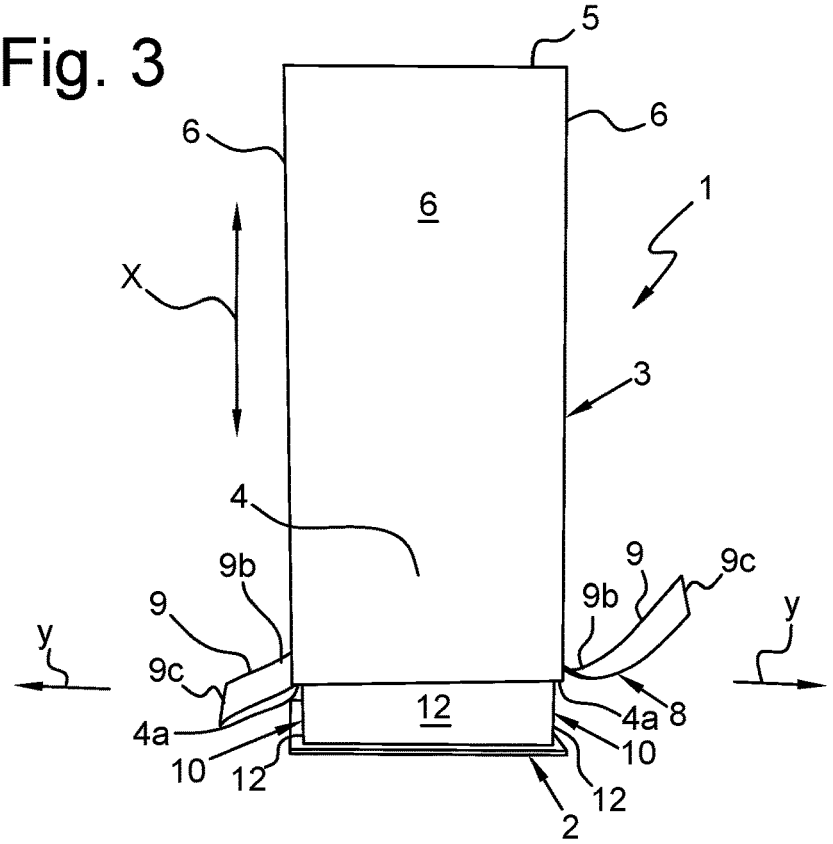
FIG. 3 is a front elevation view of the package of FIGS. 1 and 2, represented switching between the closing condition and the opening condition.
Figure 4:
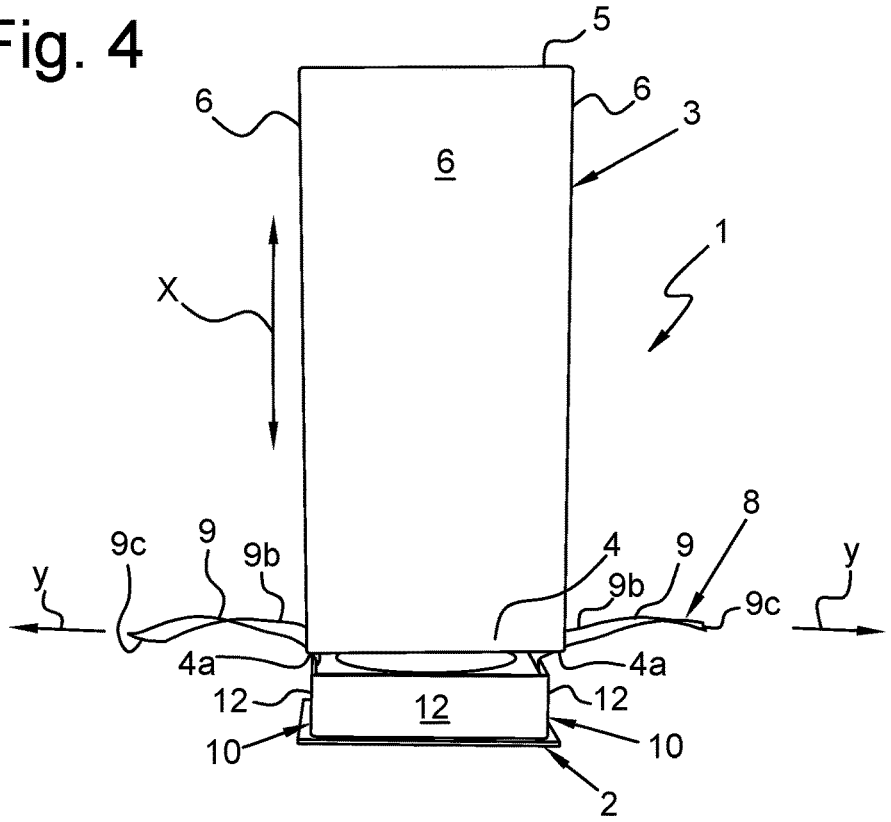
FIG. 4 is a front elevation view of the package of FIGS. 1 to 3, represented in an opening condition.
Figure 5:
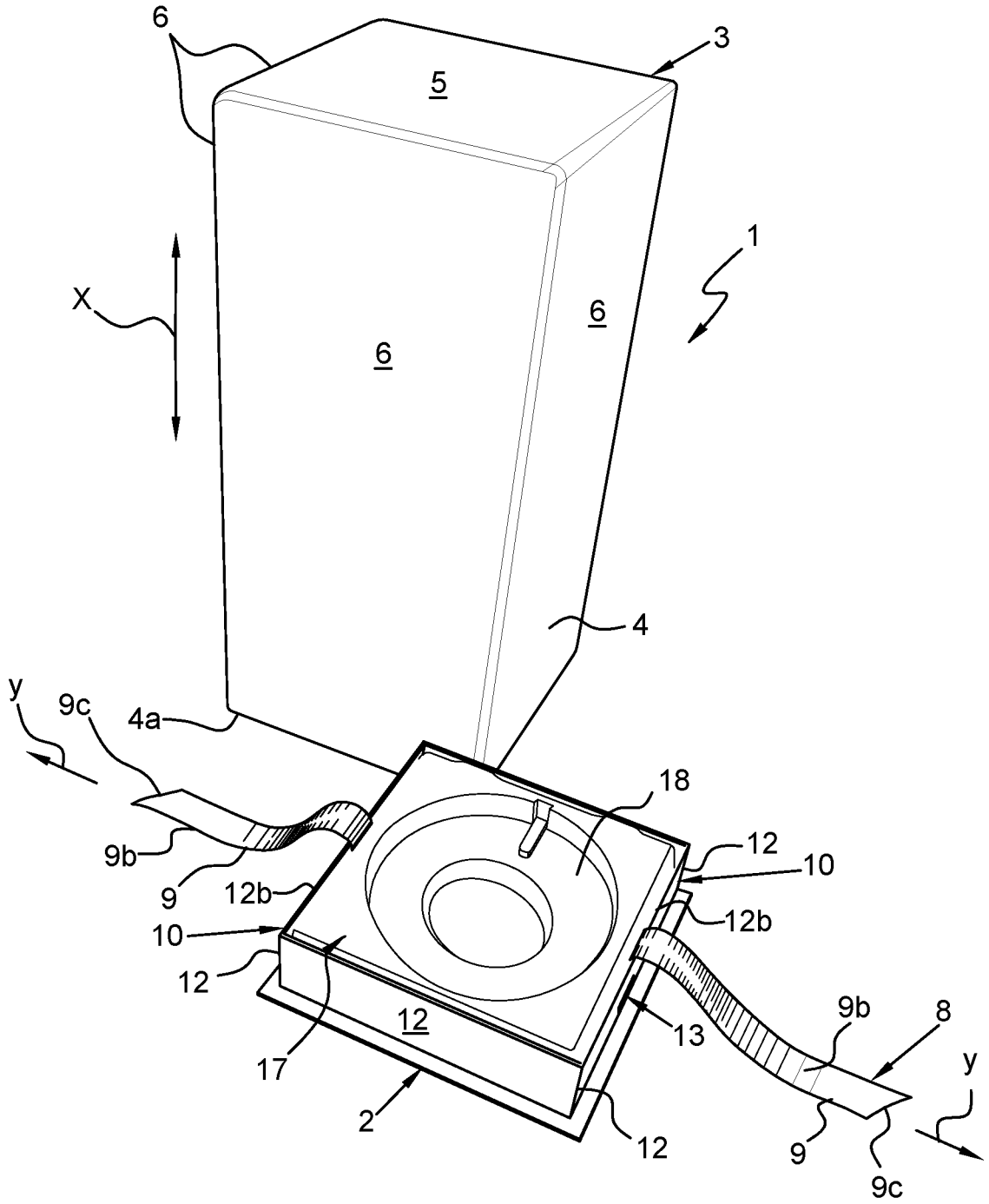
FIG. 5 is a partially exploded perspective view of the package of FIGS. 1 to 4.
Figure 6:
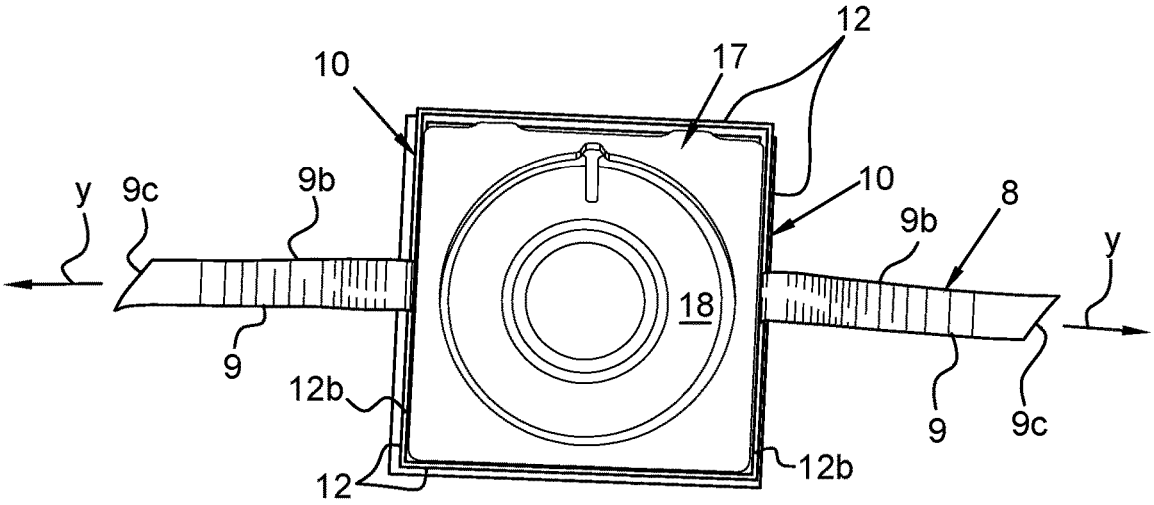
FIG. 6 is a plan view of a component of the package of FIGS. 1 to 5.
Figure 7:
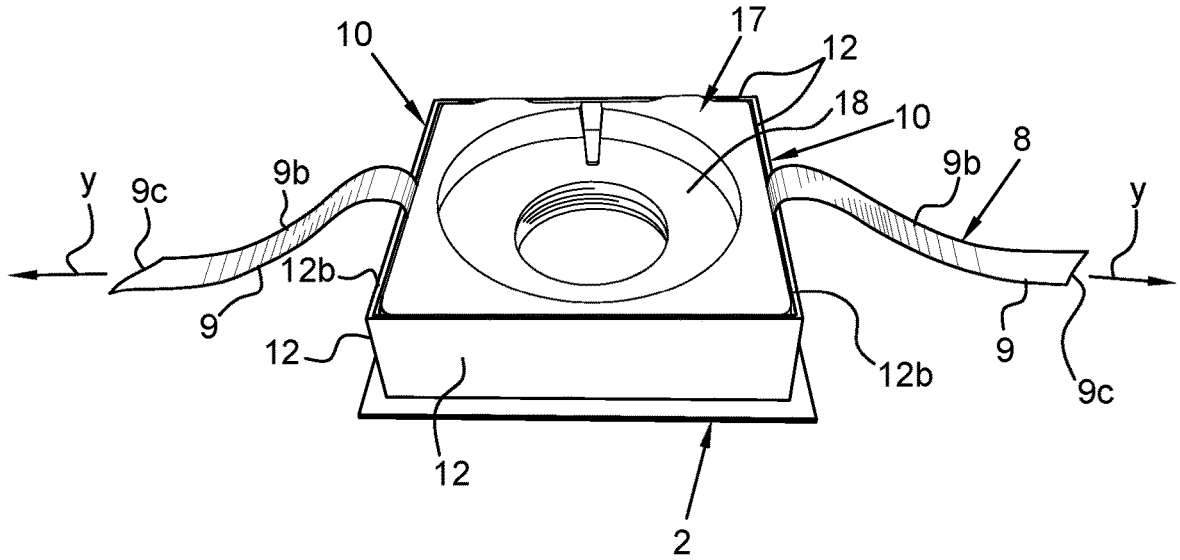
FIG. 7 is a perspective front view and from above of the component of FIG. 6.

With reference to the appended figures, the number 1 indicates overall a package for valuable products, according to the present disclosure.

As can be seen in FIGS. 1 to 10 and 12, the package 1 comprises at least one support base 2 having at least one supporting surface 2*a* (FIGS. 10 and 12) for at least one product (not shown as known) to be supported and contained.

With reference to FIGS. 1 to 5 and 12, the package 1 comprises at least one hollow body 3 that has at least an open portion 4 for the insertion of the product to be supported and contained.

The hollow body 3 is engageable to the support base 2 along a relative movement direction X substantially perpendicular to the supporting surface 2*a* of the latter.

Figure 11:
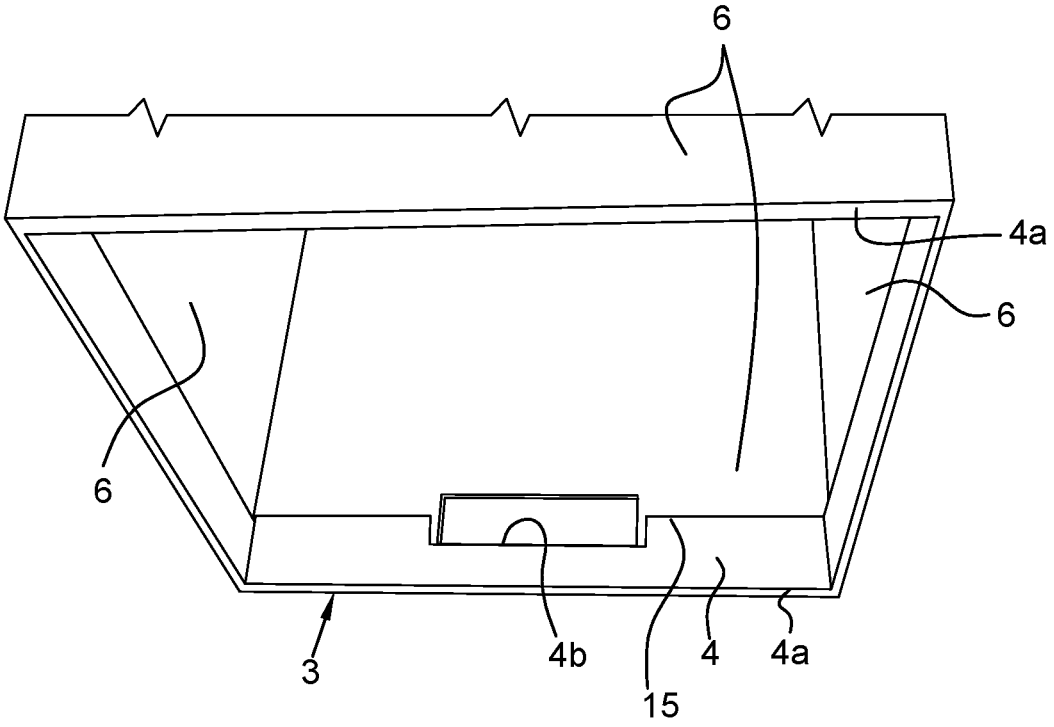
FIG. 11 is an internal schematic view of the package of FIGS. 1 to 5 to allow a detail not visible from the outside to be visible.

In detail, the hollow body 3 comprises, on the opposite side with respect to the open portion 4, a covering portion 5 from which at least one side wall 6 develops transversally, preferably perpendicularly, so as to define a housing compartment 7 (FIGS. 11 and 12) for at least one part of the product to be contained and supported.

With reference to the embodiment illustrated in FIGS. 1 to 5, the covering portion 5 of the hollow body 3 has a polygonal conformation, optionally square, from which four side walls 6 develop according to a substantially prismatic configuration.

Advantageously, the package 1 further comprises at least one opening mechanism 8 operatively interposed between the support base 2 and the hollow body 3.

The opening mechanism 8 is switchable between a closing condition (FIGS. 1, 2 and 12), wherein the hollow body 3 is in contact with the support base 2 or is placed close to the latter and an opening condition (FIGS. 3 and 4), wherein the hollow body 3 is spaced from the support base 2 so as to allow the access to the product resting on the latter.

The switching of the opening mechanism 8 between the closing condition and the opening condition is advantageously executable by actuating at least one control element 9 of the opening mechanism 8 along a control direction Y substantially transverse to the relative movement direction X between the hollow body 3 and the support base 2.

According to an advantageous aspect of the present disclosure, the switching of the opening mechanism 8 between the closing condition and the opening condition is executed by actuating at least two opposite control elements 9, each along a respective control direction Y substantially transverse to the relative movement direction X between the support base 2 and the hollow body 3.

Preferably, each control element 9 of the opening mechanism 8 has an elongated structure, advantageously band-shaped.

In detail, each control element 9 comprises a first portion 9*a* fixed to the support base 2 (FIGS. 10 and 12) and a second portion 9*b* (FIGS. 6 to 10 and 12) arranged to cooperate with at least one respective interaction portion 10 of the support base 2 and at least one respective edge 4*a* (FIGS. 1, 3 to 10 and 12) of the opening portion 4 of the hollow body 3.

The actuation of each control element 9 along the respective control direction Y causes an interaction of the respective second portion 9*b* with the respective interaction portion 10 of the support base 2 so as to cause a thrust of the hollow body 3 along the relative movement direction X between the closing condition and the opening condition due to the action of the second portion 9*b* of the control element 9 itself against the respective edge 4*a* of the opening portion 4 of the hollow body 3.

Figure 10:
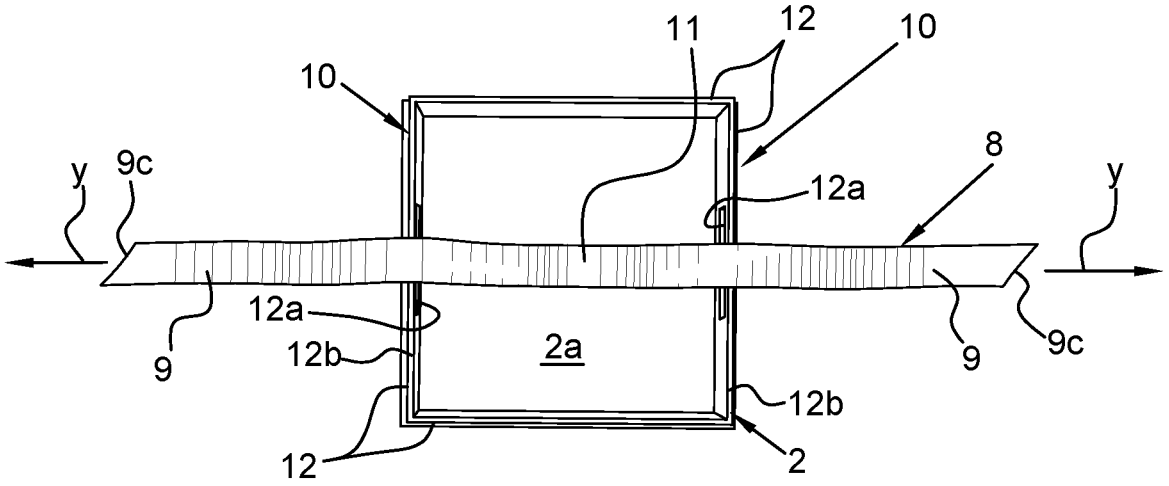
FIG. 10 is a plan view of the component of FIGS. 6 to 9 with an element removed to allow further details to be visible.

As can be seen in FIG. 10, each control element 9 of the opening mechanism 8 is part of the same elongated structure, preferably band-shaped, that engages the support base 2.

Still with reference to FIG. 10, the first portion 9*b* of each control element 9, which converges towards the first portion 9*b* of the other control element 9, corresponds to a respective fixing point 11 of the elongated structure of the opening mechanism 8 at the support base 2.

As can be seen in FIG. 10, the second portion 9*b* of each control element 9 develops between the respective first portion 9*a* and a respective terminal edge 9*c* (FIGS. 1 to 10 and 12) lying, at least at the closing condition, interposed between the respective interaction portion 10 of the support base 2 and the respective edge 4*a* of the opening portion 4 of the hollow body 3 with the respective terminal edge 9*c* arranged outside the package 1 (FIGS. 1 to 4 and 12) according to a position that allows the respective control element 9 to be operated.

In more detail, each interaction portion 10 of the support base 2 cooperating with a respective control element 9 of the opening mechanism 8 comprises at least one respective lateral wall 12 (FIGS. 3 to 10 and 12) lying on a transverse plane, substantially perpendicular, to the supporting surface 2*a* of the product to be contained and supported.

Preferably, the support base 2 is conformed so as to have substantially the same shape as the section of the hollow body 3.

With particular reference to the embodiment illustrated in FIGS. 5 to 10, the support base 2 has a substantially polygonal conformation, in particular square, therefore being provided with four side walls 12 that develop transversally, preferably perpendicularly, from the supporting surface 2*a* of the support base itself.

Two of the side walls 12 of the support base 2, arranged on opposite sides, constitute the aforementioned interaction portions 10 that cooperate with the control elements 9 of the opening mechanism 8 to allow the switching of the hollow body 3 from the closing condition to the opening condition.

Advantageously, the package 1 also comprises at least one hooking mechanism 13 (FIGS. 8, 9 and 12) operatively interposed between the support base 2 and the hollow body 3 so as to maintain the latter joined when, at the closing condition, they are mutually engaged.

The opening mechanism 8 is operatively connected to the hooking mechanism 13 to release the support base 2 from the hollow body 3 allowing the relative movement of the latter when the opening mechanism 8 is switched from the closing condition to the opening condition.

Figure 8:
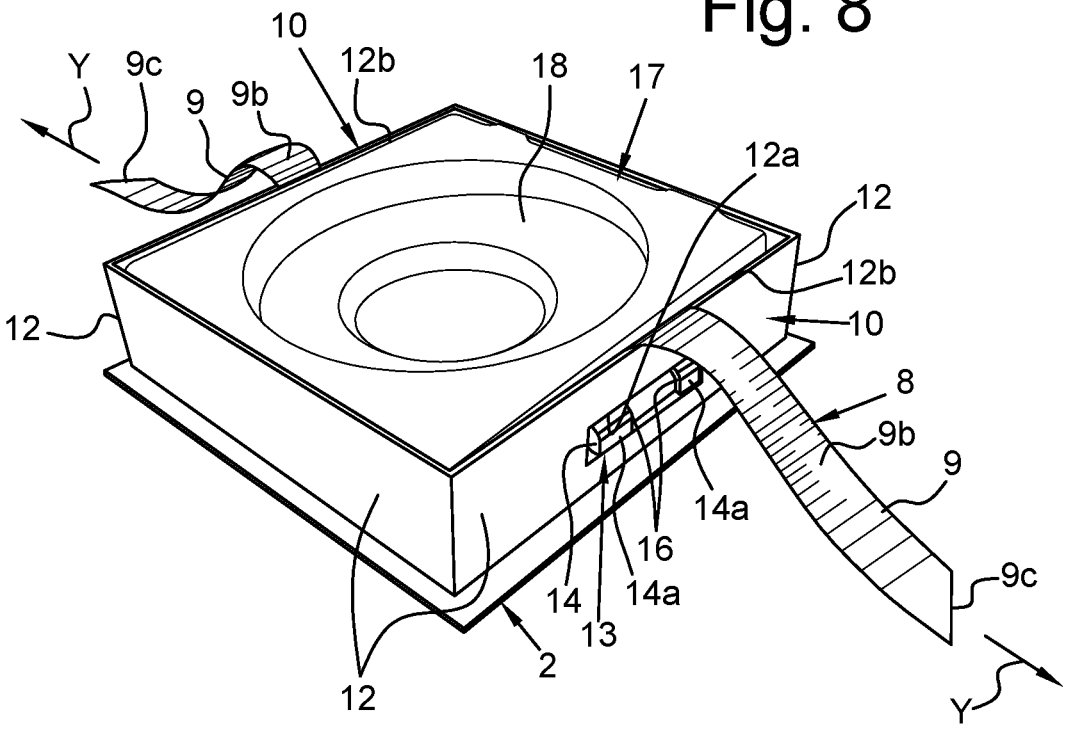
FIG. 8 is a further perspective view from above of the component of FIGS. 6 and 7.
Figure 9:
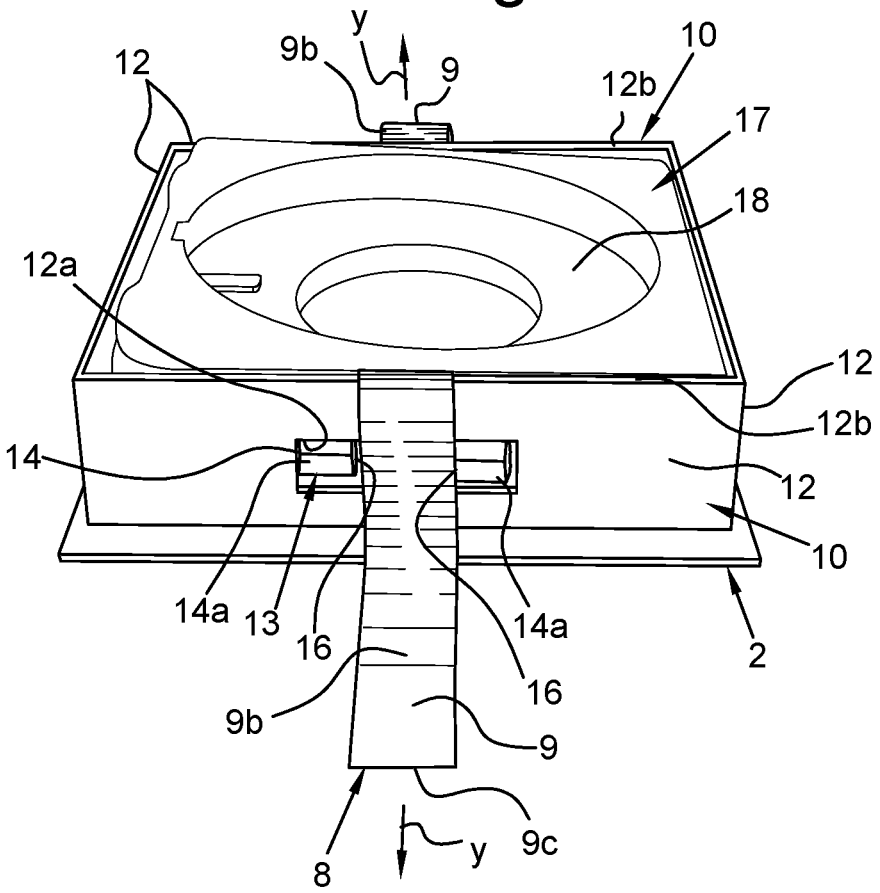
FIG. 9 is another perspective view from above of the component of FIGS. 6 to 8.
Figure 12:
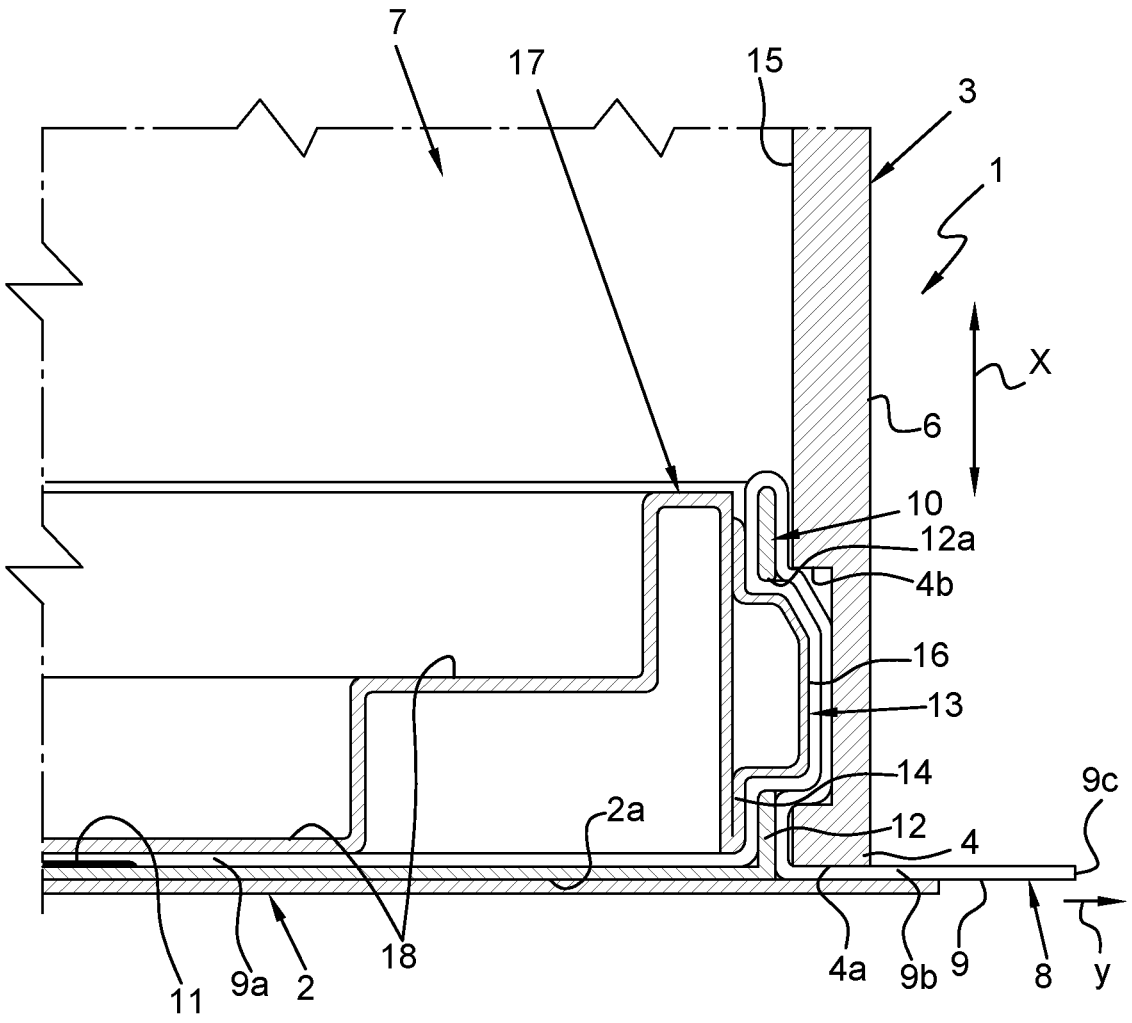
FIG. 12 is a schematic semi-section of the package of FIGS. 1 to 5 performed along the trace XII-XII of FIG. 2.

As can be seen in FIGS. 8, 9 and 12, the opening mechanism 13 comprises, for each interaction element 10 of the support base 2, at least one corresponding hooking element 14. Each hooking element 14 develops along a respective through opening 12*a* made through a respective interaction element 10 of the support base 2 to engage, at the closing condition, a respective hooking seat 4*b* (FIGS. 11 and 12) obtained on a respective inner surface 15 of the hollow body 3 near to the respective edge 4*a* of the open portion 4 of the latter.

Still with reference to FIGS. 8, 9 and 12, each hooking element 14 of the hooking mechanism 13 is provided with an engagement seat 16 for the second portion 9*b* of a respective control element 9 of the opening mechanism 8 so that, when in the closing condition, the respective control element 9 can occupy, at least in part, such engagement seat 16.

With particular reference to the embodiment illustrated in FIGS. 8 and 9, each hooking element 14 comprises two reliefs 14*a* that project, at the closing condition, through the respective through opening 12*a* of the respective interaction portion 10 of the support base 2, towards the hollow body 3 for engaging the respective hooking seat 4*b* made inside the latter. Between the aforementioned reliefs 14*a* the relative engagement seat 16 is situated for the engagement of the respective control element 9 of the opening mechanism 8.

With particular reference to the schematic section of FIG. 12, at the closing condition, the second portion 9*b* of each control element 9 develops: at least partially from inside to outside the support structure 2 passing in correspondence of the respective through opening 12*a* of the corresponding interaction element 10, between the respective engagement seat 16 of the respective hooking element 14 and the respective hooking seat 4*b* of the hollow body 3; from outside to inside of the support structure 2 starting from the corresponding through opening 12*a* of the respective interaction element 10 up to reach a terminal ridge 12*b* of the latter; from inside to outside of the support structure 2 straddling the respective terminal ridge 12*b* of the corresponding interaction element 10; outside of the supporting structure 2 to lie on the corresponding interaction element 10 passing over the through opening of the latter and on the engagement seat 16 of the respective hooking element 14 already occupied by a portion of the respective control element 9, according to a position interposed between the support structure 2 and the hollow body 3.

Advantageously, each hooking element 14 of the hooking mechanism 13 develops from a support insert 17 (FIGS. 5 to 9 and 12) engageable to the supporting surface 2*a* of the support structure 2 between the interaction elements 10 of the latter.

The support insert 17 defines a support seat 18 for supporting the respective product according to a raised position with respect to the supporting surface 2*a* of the support structure 2.

According to a preferred aspect of the present disclosure, the support base 2 and the hollow body 3 are made of a paper material, whereas the support insert 16 can be made of thermoformed plastic material or pressed cardboard pulp.

Advantageously, the opening mechanism can be manually activated.

To release the hooking elements 14 from the respective hooking seats 4*b* of the hollow body 3 and determine the lifting of the latter with respect to the support base 2, it is sufficient to pull the control elements 9 along the control directions Y, i.e. away from the hollow body 3.

The traction of the control elements 9 determines the cooperation thereof with the respective interaction portions 10 of the support base 2 which leads to the consequent lifting of the respective second portions 9*b* on which the hollow body 3 rests.

By lifting, the second portions 9*b* of the control elements 9 push the hollow body upwards until the package 1 opens.

Once the package 1 is open, it is possible to remove the hollow body pulling downwards the support base 2 with the product supported by it uncovered and accessible.

The package 1 described above solves the problems encountered in the prior art and has important advantages.

First of all, the package according to the present disclosure allows the easy and simple opening thereof.

Additionally, the opening of the described package is comfortable.

It is also to be noted that by pulling the control elements outwards away from each other it is possible to open the package with a single gesture.

Last but not least, the opening system provided on the described package allows totally safe opening as the package remains stably resting on a reference plane during the traction action of the control elements 9. As soon as the hollow body is lifted from the support base it is possible to slip it off from the product contained removing it from its position.

The invention claimed is:

1. A package for valuable products comprising:

a support base having at least one supporting surface for at least one product to be supported and contained;

a hollow body having at least one open portion to allow the insertion of the at least one product to be supported and contained, the hollow body being engageable to the support base along a relative movement direction perpendicular to the at least one supporting surface of the support base, and an opening mechanism operatively interposed between the support base and the hollow body, the opening mechanism being switchable between a closing condition, wherein the hollow body is in contact with the support base or is placed close to the support base, and an opening condition, wherein the hollow body is spaced from the support base so as to allow the access to the at least one product resting on the support base, the switching of the opening mechanism between the closing condition and the opening condition being operable by the actuation of at least one control element along a control direction transverse with respect to the relative movement direction between the hollow body and the support base, wherein the switching of the opening mechanism between the closing condition and the opening condition being executable by actuating at least two control elements disposed along respective directions transverse to the relative movement direction between the support base and the hollow body, wherein each control element of the opening mechanism has an elongated structure, band-shaped, wherein each control element comprises a first portion fixed to the support base and a second portion arranged to cooperate with at least one interaction portion of the support base and at least one edge of an opening portion of the hollow body, the actuation of each control element along the respective control direction causing an interaction of the respective second portion with the at least one interaction portion of the support base so as to cause a thrust of the hollow body along the relative movement direction between the closing condition and the opening condition following the action of the second portion of the control element against the at least one edge of the opening portion of the hollow body.

2. The package according to claim 1, wherein each control element of the opening mechanism is part of the same elongated structure, band-shaped, engaging the support base, the first portion of each control element, coinciding with the first portion of the other control element, corresponding with a respective fixing point of the elongated structure to the support base, the second portion of each control element developing between the respective first portion and a respective terminal edge of the same control element and lying, interposed between the at least one interaction portion of the support base and the at least one edge of the opening portion of the hollow body with the respective terminal edge arranged outside the package according to a position that allows the respective control element to be operated, at least at the closing condition.

3. The package according to claim 1, wherein each interaction portion of the support base cooperating with a respective control element of the opening mechanism comprises at least one respective lateral wall lying on a transverse plane, perpendicular, to the at least one supporting surface.

4. The package according to claim 3, further comprising a hooking mechanism operatively interposed between the support base and the hollow body so as to maintain the support base and the hollow body joined when engaged to each other, at the closing condition, the opening mechanism being operatively connected to the hooking mechanism to mutually disengage the hollow body and the supporting base so as to allow the relative movement of the supporting base when the opening mechanism is switched from the closing condition to the opening condition.

5. The package according to claim 4, wherein the opening mechanism comprises, for each interaction portion of the support base, at least one corresponding hooking element developing along a respective through opening made through the respective interaction portion to engage, in the closing condition, a respective hooking seat obtained on a respective inner surface of the hollow body.

6. The package according to claim 5, wherein each hooking element of the hooking mechanism is provided with an engagement seat for the second portion of a respective control element of the opening mechanism so that, when in the closing condition, the respective control element develops:

at least partially from inside to outside a support structure passing in correspondence of the respective through opening of the corresponding interaction portion, between the engagement seat of the respective hooking element and the respective engagement seat of the hollow body;

from outside to inside the support structure starting from the corresponding through opening of the respective interaction portion up to a terminal ridge of the respective interaction portion;

from inside to outside of the support structure straddling the respective terminal ridge of the corresponding interaction portion;

outside of the supporting structure to lie on the corresponding interaction portion passing over the through opening of the corresponding interaction portion and on the engagement seat of the hooking element already occupied by a portion of the same control element, according to a position interposed between the support structure and the hollow body.

7. The package according to claim 6, wherein each hooking element of the hooking mechanism develops from a support insert engageable to the at least one supporting surface of the support structure between the corresponding interaction portions of the support structure, the support insert defining a support seat for supporting the respective product at a raised position with respect to the at least one supporting surface of the support structure.

8. The package according to claim 1, wherein the opening mechanism is configured to be operated manually.

* * * * *